US009933191B2

(12) United States Patent
Mahmoud et al.

(10) Patent No.: US 9,933,191 B2
(45) Date of Patent: Apr. 3, 2018

(54) FALLING FILM EVAPORATOR FOR MIXED REFRIGERANTS

(71) Applicant: NANJING TICA AIR-CONDITIONING CO., LTD., Jiangsu (CN)

(72) Inventors: Ahmad M. Mahmoud, Bolton, CT (US); Jaeseon Lee, Galstonbury, CT (US)

(73) Assignee: Nanjing TICA Air-Conditioning Co., LTD, Nanjing (CN)

( * ) Notice: Subject to any disclaimer, the term of this patent is extended or adjusted under 35 U.S.C. 154(b) by 130 days.

(21) Appl. No.: 14/787,634

(22) PCT Filed: May 1, 2014

(86) PCT No.: PCT/US2014/036381

§ 371 (c)(1),
(2) Date: Oct. 28, 2015

(87) PCT Pub. No.: WO2014/179576

PCT Pub. Date: Nov. 6, 2014

(65) Prior Publication Data

US 2016/0076799 A1 Mar. 17, 2016

Related U.S. Application Data

(60) Provisional application No. 61/818,086, filed on May 1, 2013.

(51) Int. Cl.
*F25B 9/00* (2006.01)
*F25B 39/00* (2006.01)
(Continued)

(52) U.S. Cl.
CPC ..... *F25B 39/00* (2013.01); *F01K 25/06* (2013.01); *F01K 25/08* (2013.01); *F22B 1/021* (2013.01);
(Continued)

(58) Field of Classification Search
CPC ..... F25B 39/00; F25B 39/028; F25B 39/02
(Continued)

(56) References Cited

U.S. PATENT DOCUMENTS 3,831,390 A * 8/1974 Hopkins ..... F25B 15/06 62/101
5,561,987 A 10/1996 Hartfield et al.
(Continued)

OTHER PUBLICATIONS

International Preliminary Report on Patentability, International Application No. PCT/US2014/036381, dated Feb. 2, 2016, 9 pages.

*Primary Examiner* — Melvin Jones
(74) *Attorney, Agent, or Firm* — Oliff PLC

(57) ABSTRACT

A system (10) includes a fluid with components that evaporate at different temperatures, a condenser (12) with an inlet (22) and an outlet (24), a pump (14) with an outlet (28) and with an inlet (26) connected to the outlet (24) of the condenser (12), and an evaporator (16). The evaporator (16) includes an inlet (30) connected to the outlet (28) of the pump (14), an outlet (31), evaporating tubes (38), pool boiling tubes (42), and a fluid distribution system (33) for spraying the fluid over the evaporating tubes (38). The system (10) further includes a turbine (18) with an inlet (44) connected to the outlet (31) of the evaporator (16), an outlet (48) connected to the inlet (22) of the condenser (12), and a drive shaft (46). A generator (20) is connected to the drive shaft (46) of the turbine (18).

21 Claims, 4 Drawing Sheets

(51) Int. Cl.

| | |
|---|---|
| ***F01K 25/06*** | (2006.01) |
| ***F01K 25/08*** | (2006.01) |
| ***F28D 7/00*** | (2006.01) |
| ***F28D 7/16*** | (2006.01) |
| ***F22B 1/02*** | (2006.01) |
| ***F22B 27/16*** | (2006.01) |
| *F25B 39/02* | (2006.01) |
| *F28D 21/00* | (2006.01) |

(52) U.S. Cl.
CPC ..... *F22B 27/16* (2013.01); *F28D 7/0083* (2013.01); *F28D 7/1607* (2013.01); *F25B 39/02* (2013.01); *F25B 2339/024* (2013.01); *F25B 2339/0242* (2013.01); *F28D 2021/0071* (2013.01)

(58) Field of Classification Search
USPC ..... 62/87, 498, 515, 524, 525
See application file for complete search history.

(56) References Cited

U.S. PATENT DOCUMENTS

| | | | | |
|---|---|---|---|---|
| 5,588,596 | A | 12/1996 | Hartfield et al. | |
| 5,645,124 | A | 7/1997 | Hartfield et al. | |
| 5,839,294 | A * | 11/1998 | Chiang | F25B 39/02 165/117 |
| 6,167,713 | B1 | 1/2001 | Hartfield et al. | |
| 6,293,112 | B1 | 9/2001 | Moeykens et al. | |
| 6,357,239 | B2 * | 3/2002 | Carey | F25B 31/004 62/84 |
| 6,830,099 | B2 | 12/2004 | Moeykens | |
| 6,868,695 | B1 | 3/2005 | Dingel et al. | |
| 7,849,710 | B2 | 12/2010 | De Larminat et al. | |
| 2011/0047958 | A1 | 3/2011 | Yamashita et al. | |
| 2012/0118545 | A1 | 5/2012 | Ayub et al. | |

* cited by examiner

FALLING FILM EVAPORATOR FOR MIXED REFRIGERANTS

CROSS-REFERENCE TO RELATED APPLICATION(S)

This application claims priority from U.S. Provisional Application No. 61/818,086, filed May 1, 2013 for "FALLING FILM EVAPORATOR FOR MIXED REFRIGERANTS" by Ahmad M. Mahmoud et al.

BACKGROUND

The present invention relates to power generation systems and refrigeration systems, and more specifically relates to a system with evaporator employing mixed refrigerants for power generation systems and refrigeration systems.

The Organic Rankine Cycle (ORC) is commonly used as a power generation system for low temperature resources such as geothermal, solar thermal, biomass, and waste heat recovery. The primary components of an ORC system include an expansion device, a condenser, an evaporator/gas heater, and a motive pump. Traditionally Organic Rankine Cycle systems employ flooded evaporators, which use a shell and tube construction in order to evaporate a pool of liquid to produce superheated vapor. In typical flooded evaporators, a resource, such as hot water or hot fluid, flows through tubes. In less conventional systems, a hot gas flows through smoke tubes. The resource facilitates heat exchange between a pool of liquid, usually a working fluid comprised of a refrigerant, and the surface of the tubes to evaporate the liquid, resulting in superheated vapor. To continue the cycle, the superheated vapor exits the evaporator, expands in a turbine, spinning a generator, which then produces electricity. Low pressure and low temperature vapor exits the turbine and flows through a condenser where a cooler medium, such as air or water, condenses the vapor into liquid in a condenser. Liquid from the condenser is then pumped back into the pool of the flooded evaporator to repeat the cycle.

Flooded evaporators are disadvantageous for power generation cycles in terms of cost, environmental impact, footprint, and efficiency. Flooded evaporators require a significant amount of refrigerant charge to cover enough tubes to maintain sufficient heat transfer in order to evaporate the refrigerant liquid. In order to control the degree of superheat in order to maintain optimal turbine and system performance, a predetermined number of tubes remain unwetted in order to superheat the vapor being generated in the evaporator. The number of tubes that need to remain wetted is still quite significant, requiring a significant amount of refrigerant charge. Using a flooded evaporator, particularly for systems that utilize hydrofluorocarbons or other relevant working fluids, poses a significant cost concern due to the significant initial refrigerant charge, as well as the charge needed for maintenance and replenishment.

The heat transfer penalty associated with the use of non-azeotropic mixed refrigerants in conventional flooded evaporators significantly reduces the amount of power that can be generated by such a system. Some non-azeotropic mixed refrigerants may exhibit lower heat transfer coefficient due to a reduced interfacial temperature between the liquid and vapor phases. This reduced interfacial temperature gives rise to heat and mass transfer resistances.

SUMMARY

A system includes a fluid with components that evaporate at different temperatures, a condenser with an inlet and an outlet, a pump with an outlet and with an inlet connected to the outlet of the condenser, and an evaporator. The evaporator includes an inlet connected to the outlet of the pump, an outlet, evaporating tubes, pool boiling tubes, and a fluid distribution system for spraying the fluid over the evaporating tubes. The system further includes a turbine with an inlet connected to the outlet of the evaporator, an outlet connected to the inlet of the condenser, and a drive shaft. A generator is connected to the drive shaft of the turbine.

In another embodiment, a method of processing a fluid includes condensing the fluid in a condenser, the fluid including components that evaporate at different temperatures, pumping the fluid from the condenser into an evaporator, and spraying the fluid from a fluid distribution system in the evaporator to cover evaporating tubes in the evaporator. The method further includes dripping an excess of the fluid off of the evaporating tubes to form a pool in the evaporator, evaporating the fluid from the evaporating tubes, evaporating the fluid from the pool with pool boiling tubes, expanding the evaporated fluid in a turbine, and producing power in a generator using the fluid expanded in the turbine.

DETAILED DESCRIPTION

Figure 1:
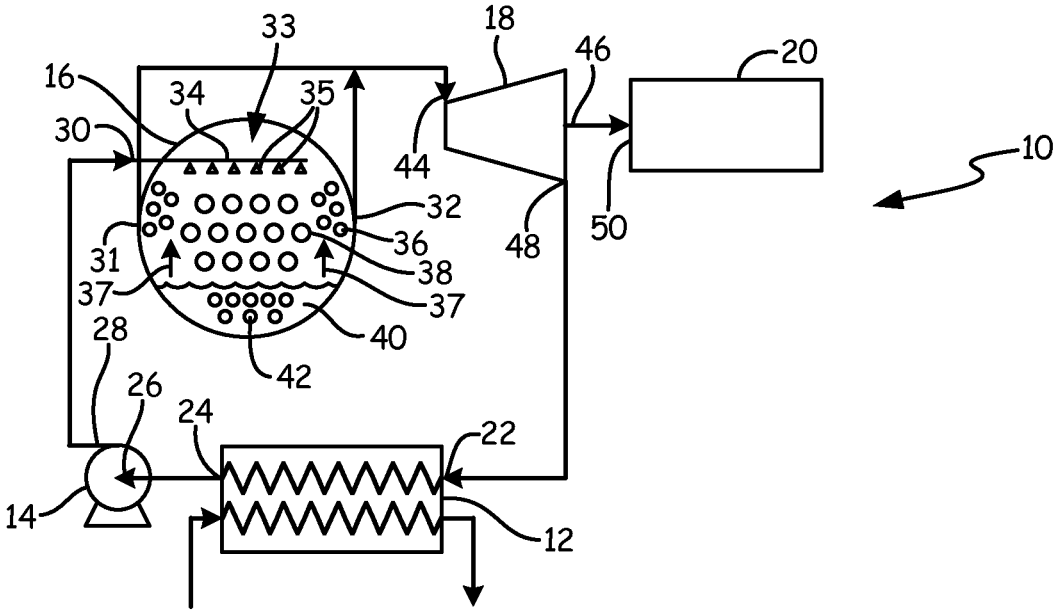
FIG. 1 is a flow schematic of the present invention.

The present invention utilizes a falling film evaporator to achieve efficient heat transfer in power generation systems, such as systems employing mixed refrigerants (non-azeotropic mixtures) in an Organic Rankine Cycle (ORC) system. Mixed refrigerants include a least volatile component and most volatile component. In order to avoid heat and mass transfer resistances associated with use of mixed refrigerants, the working fluid mixture is selected such that the heat transfer coefficient of the mixed refrigerant is greater than the smallest heat transfer coefficient of the components, for example. During evaporation, the more volatile component exists more in the vapor phase leaving the less volatile component in the liquid layer.

The falling film evaporator of the present invention may include a falling film portion with evaporating tubes as well as a pool boiling portion with pool boiling tubes for evaporating excess refrigerant falling from the evaporating tubes. The falling film evaporator of the present invention may include a recirculation pump as an alternative to pool boiling tubes. The falling film evaporator of the present invention may also include a means for superheating to ensure optimal turbine and system performance. The fluid employed in the falling film evaporator of the present invention may be a dry working fluid (not requiring superheat) or a wet working fluid (requiring superheat). The falling film evaporator design reduces refrigerant charge necessity by 30%-70% as compared to a flooded evaporator. The falling film evaporator of the present invention enhances heat transfer, reduces cost, and reduces the size and footprint of state-of-the-art power generation systems.

The fluid employed in the falling film evaporator of the present invention is a mixed refrigerant, which may be a dry working fluid (not requiring superheat) or a wet working fluid (requiring superheat). Mixed refrigerants are made up of two or more components that have different molecular weights, different densities, and different normal boiling points. Mixed refrigerants may exhibit certain properties such as temperature glide during phase change, pressure or bubble point temperature in both the condenser and the evaporator, and a mixture critical pressure that increases, or maximizes, for example, the power generation potential and cycle thermal efficiency during an ORC. Temperature glide is the temperature difference between the saturated vapor temperature and the saturated liquid temperature of a working fluid mixture. The mixed refrigerant temperature glide may be, for example, between about five and thirty degrees Celsius, and more specifically between about 6-8° K and 20-25° K, for example.

The working fluid mixture may also exhibit other characteristics during the Rankine cycle such as, for example, low global warming potential (GWP), low flammability, low ozone depletion potential, or low toxicity. GWP is a relative measure of how much heat a greenhouse gas traps in the atmosphere relative to carbon dioxide for the atmospheric lifetime of the species. The GMP of carbon dioxide is standardized to 1. The GWP of the working fluid mixture may be, for example, less than about 675, or more specifically, less than about 150-250, for example. The working fluid mixture may be, for example, non-flammable.

The working fluid mixture may be manufactured by mixing together a plurality of different chemical components, such as organic chemical components, for example. The working fluid mixture may include, for example, a plurality of the chemical components listed in Table 1 below.

TABLE 1

| Chemical Group | Representative Chemical Components (CAS Registry Number) |
|---|---|
| Hydrocarbon | Propane (74-98-6), butane (106-97-8), pentane (109-66-0), hexane (110-54-3), heptanes (142-82-5), octane (111-65-9), nonane (111-84-2), decane (124-18-5), ethylene (74-85-1), propylene (115-07-1), propyne (74-99-7), isobutene (75-28-5), isobutene (115-11-7), 1butene (106-98-9), c2butene (590-18-1), cyclepentane (287-92-3), isopentane (78-78-4), neopentane (463-82-1), isohexane (107-83-5), cyclohexane (110-82-7) |
| Fluorocarbon | R14 (75-73-0), R218 (76-19-7) |
| Ether | RE170 (dimethyl ether 115-10-6) |
| Hydrochlorofluorocarbon | R21 (75-43-4), R22 (75-45-6), R30 (75-09-2), R32 (75-10-5), R41 (593-53-3), R123 (306-83-2), R124 (2837-89-0) |
| Hydrofluorocarbon | R134a (811-97-2), R143a (420-46-2), R152a (75-37-6), R161 (353-36-6), R23 (75-46-7), R227ea (431-89-0), R236ea (431-63-0), R236fa (690-39-1), R245ca (679-86-7), R245fa (460-73-1), R365mfc (406-58-6), R338mccq (662-35-1) |
| Fluorinated Ketone | 1,1,1,2,2,4,5,5,5-nonafluoro-4-(trifluoromethyl)-3-pentanone (e.g., Novec ®649) (756-13-8), C7FK (C7 fluoroketone) |
| Hydrofluoro ether | RE125 (3822-68-2), RE134, RE143a (421-14-7) RE236fa, RE245cb2 (22410-44-2), RE245fa2 (1885-48-9), HFE-7000 (C3F7OCH3), HFE-7100 (C4F9OCH3), HFE-7200 (C4F9OC2H5) |
| Hydrochlorofluoro olefin | R1233zd (102687-65-0), 2-chloro-3,3,3-trifluoropropene |
| Bromofluoro olefin | C5F9Cl |
| Fluoro olefin | R1216 (116-15-4) |
| Hydrofluoro olefin | R1234yf (754-12-1), R1234ze (1645-83-6), R1243zf (677-21-4), R1225ye (5595-10-8) |

TABLE 1-continued

| Chemical Group | Representative Chemical Components (CAS Registry Number) |
|---|---|
| Cyclic siloxane<br>Linear siloxane | D2 (7782-39-0), D4 (556-76-2), D5 (541-02-6), D6 (540-97-6) MM (107-46-0), MDM (107-51-7), MD2M (141-62-8), MD3M (141-63-9), MD4M (00107-52-8) |

The chemical components may be selected, for example, in order to tailor the heat exchanger temperature glide, the heat exchange pressure, the bubble point temperature and/or other characteristics, such as the GWP or the flammability, for example, of the working fluid mixture to a particular ORC system design and application. The working fluid mixture included in power generation systems may include two or more chemical components listed above.

FIG. 1 is a flow schematic of system 10 including condenser 12, pump 14, evaporator 16, turbine 18, and generator 20. Condenser 12 includes inlet 22 and outlet 24. Pump 14 includes inlet 26 and outlet 28. Evaporator 16 consists of a shell through which superheating tubes 36, evaporating tubes 38, and pool boiling tubes 42 pass horizontally in tube bundles. Evaporator 16 also includes inlet 30, outlet 31, outlet 32, distribution system 33 with spray manifold 34 and spray nozzles 35, vapor lanes 37, and pool 40. Turbine 18 includes inlet 44 and outlet 48. Drive shaft 46 connects turbine 18 to generator 20.

System 10 processes a fluid, such as a wet working fluid requiring superheat, and may be an ORC system, such as a power generation system or a refrigeration system. The fluid is a mixed refrigerant, as described above. The fluid enters evaporator 16 through inlet 30 using pump 14. Distribution system 33 uses spray nozzles 35 attached to spray manifold 34 to spray subcooled fluid at high pressure over evaporating tubes 38.

Distribution system 33 is arranged in an overlaying relationship with the upper most level of the top of evaporating tubes 38. Evaporating tubes 38 consist of tube bundles which are positioned in a staggered manner under distribution system 33 to maximize contact with the fluid sprayed out of distribution system 33 onto the upper portion of evaporating tubes 38. To begin the evaporation process, the first row of evaporating tubes 38 is sprayed with subcooled fluid. Distribution system 33 is designed such that the first row of evaporating tubes 38 is drenched and covered but not oversupplied with fluid, starting the evaporation process. The fluid falls down subsequent rows of evaporating tubes 38. The fluid falling off the last row of evaporating tubes 38 collects and forms pool 40 at the bottom of evaporator 16. A control system may be employed to ensure that no dry-out occurs along the length and width of evaporating tubes 38.

Due to temperature glide, the most volatile component, i.e. the component with the lowest normal boiling point, of the fluid will begin to evaporate first, while the least volatile component will remain liquid. The liberation of vapor corresponding to the most volatile component reduces the interfacial temperature difference that gives rise to heat and mass transfer resistances. The remainder of the most and least volatile mixed refrigerant falls down subsequent rows of evaporating tubes 38. The fluid falling down subsequent rows of tubes 38 may contain varying ratios of the components of the mixed refrigerant due to different evaporation locations of each component due to temperature glide. In one embodiment, the least volatile component of the fluid will not evaporate until the pool boiling tubes 36 get hot enough. Therefore, only the most volatile component will evaporate from evaporating tubes 38, and pool boiling tubes 40 will evaporate all of the least volatile component.

The fluid falling off the last row of evaporating tubes 38 collects and forms pool 40 at the bottom of evaporator 16. In one embodiment, the fluid spray from distribution system 33 is controlled such that 15% of the fluid sprayed falls off the last row of evaporating tubes 38, while the rest of the fluid sprayed is evaporated by evaporating tubes 38. In an alternative embodiment, distribution system 33 is controlled such that 20% of the fluid sprayed falls off the last row of evaporating tubes 38. In another alternative embodiment distribution system 33 is controlled such that 25% of the fluid sprayed falls off the last row of evaporating tubes 38. In other embodiments, a control system is employed to vary the percentage of fluid falling off of the law row of evaporating tubes 38 between 5% and 50%.

Pool 40 covers pool boiling tubes 42. Pool boiling tubes 42 cause the fluid in pool 40 to evaporate. Therefore, the saturated vapor generated by evaporator 16 consists of fluid evaporated by evaporating tubes 38 and pool boiling tubes 42, including both the most volatile component and least volatile component of the fluid. Without pool boiling tubes 42, the least volatile component of the fluid would not evaporate, and the fluid leaving evaporator 16 would only contain the most volatile component.

Superheating tubes 36 are located on both sides of evaporating tubes 38. The saturated vapor travels along the periphery of evaporator 16 in vapor lanes 37, and when the saturated vapor reaches superheating tubes 36, superheating tubes 36 increase the temperature of the saturated vapor at a constant pressure, which results in favorable system performance. Since the fluid in system 10 may be a wet working fluid, superheating tubes 36 provide superheating to prevent liquid droplets from forming when the fluid expands through turbine 18. Superheating tubes 36 therefore ensure that the saturated vapor is heated sufficiently to result in favorable and proper performance of turbine 18.

Once the saturated vapor is superheated by superheating tubes 36, superheated vapor exits evaporator 16 through outlets 31 and 32 and superheated vapor enters turbine 18 through inlet 44. Turbine 18 expands superheated vapor spinning drive shaft 46, which drives generator 20 to produce power. Turbine 18 may be screw-shaped, axial, radial, or any other type of positive displacement shape. Low pressure and low temperature vapor from turbine 18 flows out through outlet 48 and into condenser 12 through inlet 22. In condenser 12, a cooler medium like air or water flowing through condenser 12 condensers the vapor into subcooled liquid. Subcooled liquid from condenser 12 exits through outlet 24 and enters pump 14 through inlet 26. Pump 14 pumps subcooled liquid through outlet 28 and into inlet 30 of evaporator 16. The cycle is subsequently repeated to continue to produce power.

Figure 2:
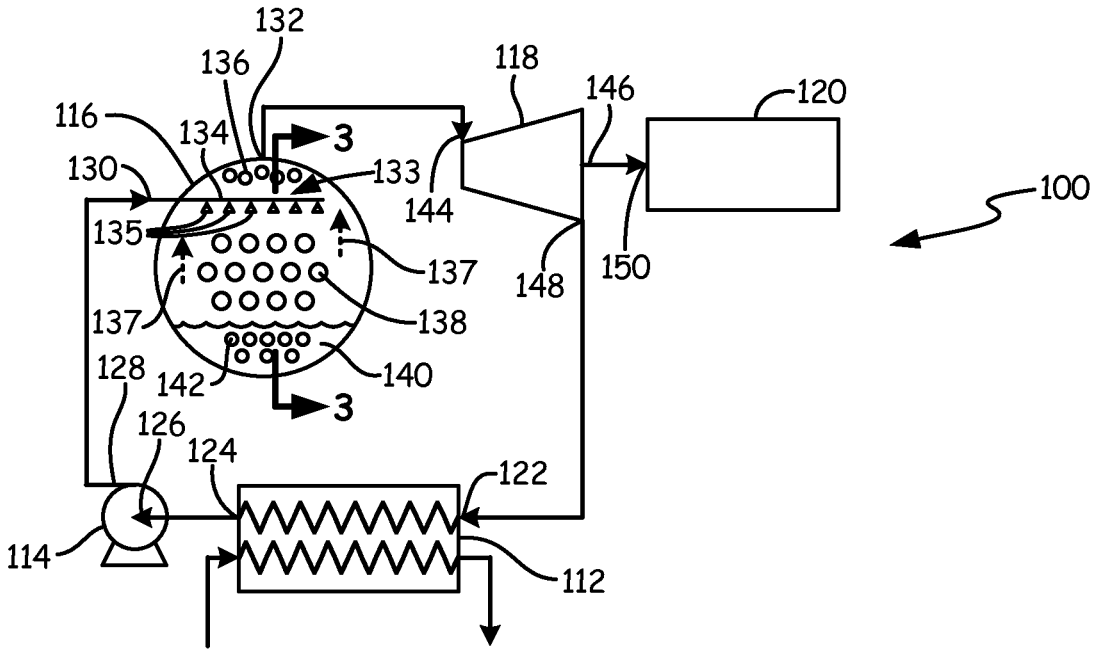
FIG. 2 is a flow schematic including an alternate embodiment evaporator of the present invention.

FIG. 2 is a flow schematic of an alternative embodiment of the present invention, system 100, including condenser 112, pump 114, evaporator 116, turbine 118, and generator 120. Condenser 112 includes inlet 122 and outlet 124. Pump 114 includes inlet 126 and outlet 128. Evaporator 116 consists of a shell through which superheating tubes 136, evaporating tubes 138, and pool boiling tubes 142 pass in tube bundles. Evaporator 116 also includes inlet 130, outlet 131, outlet 132, distribution system 133 with spray manifold 134 and spray nozzles 135, vapor lanes 137, and pool 140. Turbine 118 includes inlet 144 and outlet 148. Drive shaft 146 connects turbine 118 to generator 120.

System 100 processes a fluid, such as a wet working fluid requiring superheat, and may be an ORC system, such as a power generation system or a refrigeration system. The fluid is a mixed refrigerant. Mixed refrigerants are made up of two or more components that have different molecular weights, different densities, and different temperatures at a given pressure (temperature glide). The fluid enters evaporator 116 through inlet 130 using pump 114. Distribution system 133 uses spray nozzles 135 attached to spray manifold 134 to spray subcooled fluid at high pressure over evaporating tubes 138.

Distribution system 133 is arranged in an overlaying relationship with the upper most level of the top of evaporating tubes 138. Evaporating tubes 138 consist of tube bundles which are positioned in a staggered manner under distribution system 133 to maximize contact with the fluid sprayed out of distribution system 133 onto the upper portion of evaporating tubes 138. To begin the evaporation process, the first row of evaporating tubes 138 is sprayed with subcooled fluid. Distribution system 133 is designed such that the first row of evaporating tubes 138 is drenched and covered but not oversupplied with fluid, starting the evaporation process. The fluid falls down subsequent rows of evaporating tubes 138. The fluid falling off the last row of evaporating tubes 138 collects and forms pool 140 at the bottom of evaporator 116. A control system may be employed to ensure that no dry-out occurs along the length and width of evaporating tubes 138.

Due to temperature glide, the most volatile component, i.e. the component with the lowest normal boiling point, of the fluid will begin to evaporate first, while the least volatile component will remain liquid. The liberation of vapor corresponding to the most volatile component reduces the interfacial temperature difference that gives rise to heat and mass transfer resistances. The remainder of the most and least volatile mixed refrigerant falls down subsequent rows of evaporating tubes 138. The fluid falling down subsequent rows of tubes 138 may contain varying ratios of the components of the mixed refrigerant due to different evaporation locations of each component due to temperature glide. In one embodiment, the least volatile component of the fluid will not evaporate until the pool boiling tubes 136 get hot enough. Therefore, only the most volatile component will evaporate from evaporating tubes 138, and pool boiling tubes 140 will evaporate all of the least volatile component.

The fluid falling off the last row of evaporating tubes 138 collects and forms pool 140 at the bottom of evaporator 116. In one embodiment, the fluid spray from distribution system 133 is controlled such that 15% of the fluid sprayed falls off the last row of evaporating tubes 138, while the rest of the fluid sprayed is evaporated by evaporating tubes 138. In an alternative embodiment, distribution system 133 is controlled such that 20% of the fluid sprayed falls off the last row of evaporating tubes 138. In another alternative embodiment distribution system 133 is controlled such that 25% of the fluid sprayed falls off the last row of evaporating tubes 138. In other embodiments, a control system is employed to vary the percentage of fluid falling off of the law row of evaporating tubes 138 between 5% and 50%.

Pool 140 covers pool boiling tubes 142. Pool boiling tubes 142 cause the fluid in pool 140 to evaporate. Therefore, the saturated vapor generated by evaporator 116 consists of fluid evaporated by evaporating tubes 138 and pool boiling tubes 142, including both the most volatile component and least volatile component of the fluid. Without pool boiling tubes 142, the least volatile component of the fluid would not evaporate, and the fluid leaving evaporator 116 would only contain the most volatile component.

Superheating tubes 136 are located above spray manifold 134. The saturated vapor travels along the periphery of evaporator 116 in vapor lanes 137, and when the saturated vapor reaches superheating tubes 136, superheating tubes 136 increase the temperature of the saturated vapor at a constant pressure, which results in favorable system performance. Since the fluid in system 110 may be a wet working fluid, superheating tubes 136 provide superheating to prevent liquid droplets from forming when the fluid expands through turbine 118. Superheating tubes 136 therefore ensure that the saturated vapor is heated sufficiently to result in favorable and proper performance of turbine 118.

Once the saturated vapor is superheated by superheating tubes 136, superheated vapor exits evaporator 116 through outlets 131 and 132 and superheated vapor enters turbine 118 through inlet 144. Turbine 118 expands superheated vapor spinning drive shaft 146, which drives generator 120 to produce power. Turbine 118 may be screw-shaped, axial, radial, or any other type of positive displacement shape. Low pressure and low temperature vapor from turbine 118 flows out through outlet 148 and into condenser 112 through inlet 122. In condenser 112, a cooler medium like air or water flowing through condenser 112 condensers the vapor into subcooled liquid. Subcooled liquid from condenser 112 exits through outlet 124 and enters pump 114 through inlet 126. Pump 114 pumps subcooled liquid through outlet 128 and into inlet 130 of evaporator 116. The cycle is subsequently repeated to continue to produce power.

Figure 3:
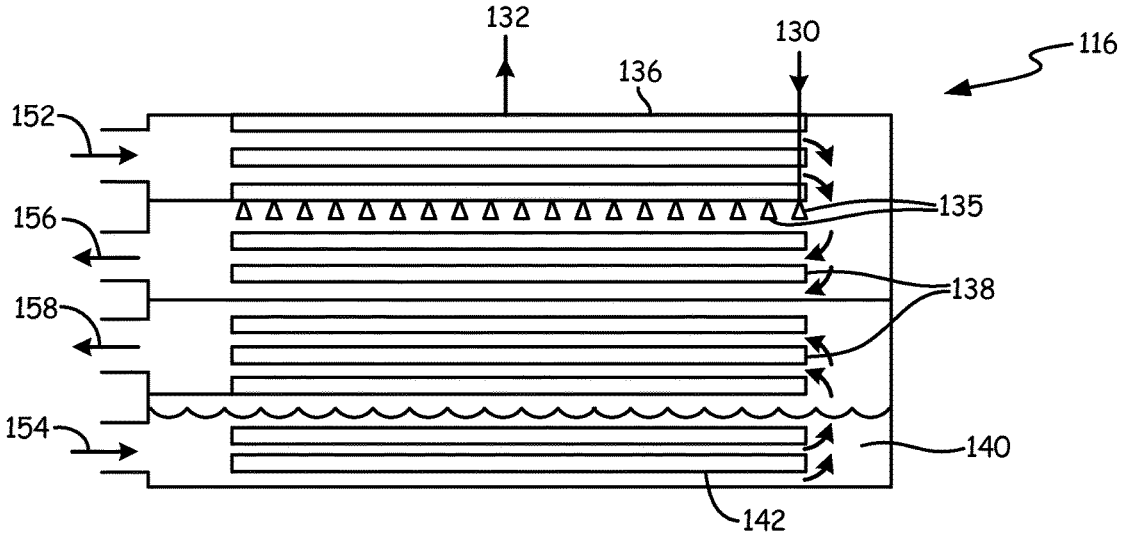
FIG. 3 is a cross section along line 3-3 in FIG. 2 of the alternate embodiment evaporator of the present invention.

FIG. 3 is a cross section of evaporator 116 of system 100 along line 3-3 in FIG. 2. Evaporator 116 consists of a shell through which superheating tubes 136, evaporating tubes 138, and pool boiling tubes 142 pass in tube bundles. Evaporator 116 also includes inlet 130, outlet 132, distribution system 133 with spray manifold 134 and spray nozzles 135, pool 140, resource inlet 152, resource inlet 154, resource outlet 156, and resource outlet 158.

Evaporator 116 is a two pass evaporator. During operation of evaporator 116, a resource, such as hot water, enters superheating tubes 136 through resource inlet 152, flows through superheating tubes 136 and into evaporating tubes 138 (as shown by the flow direction arrows), where the resource exits through resource outlet 156. The temperature of the resource is higher in superheating tubes 136 than in evaporating tubes 138. A resource, such as hot water, enters pool boiling tubes 142 through resource inlet 154, flows through pool boiling tubes 142 into evaporating tubes 138 (as shown by the flow direction arrows), where the resource exits through resource outlet 158. The temperature of the resource is higher in pool boiling tubes 142 than in evaporating tubes 138. The hot resource flow circulated through evaporating tubes 138 and pool boiling tubes 142 may be controlled by a controller such that the rate of evaporation of the most and least volatile components of a mixed refrigerant fluid is identical. This alleviates any system challenges related to the more volatile component alone being superheated and flowing to turbine 118.

Subcooled liquid enters evaporator 116 through inlet 130. Distribution system 133 uses spray nozzles 135 attached to spray manifold 134 to spray subcooled fluid at high pressure over evaporating tubes 138. The heat from the resource flowing through evaporating tubes 138 allows the fluid to begin evaporating. The fluid falls down subsequent rows of evaporating tubes 138. The fluid falling off the last row of evaporating tubes 138 collects and forms pool 140 at the bottom of evaporator 116. The heat from the resource flowing through pool boiling tubes 142 causes the fluid in pool 140 to evaporate. Therefore, the saturated vapor in evaporator 116 consists of fluid evaporated by evaporating tubes 138 and pool boiling tubes 142. The saturated vapor travels up through evaporator 116, and when the saturated vapor reaches superheating tubes 136, the heat from the resource flowing through superheating tubes 136 increases the temperature of the saturated vapor at a constant pressure. Once the saturated vapor is superheated by superheating tubes 136, superheated vapor exits evaporator 116 through outlet 132.

Figure 4:
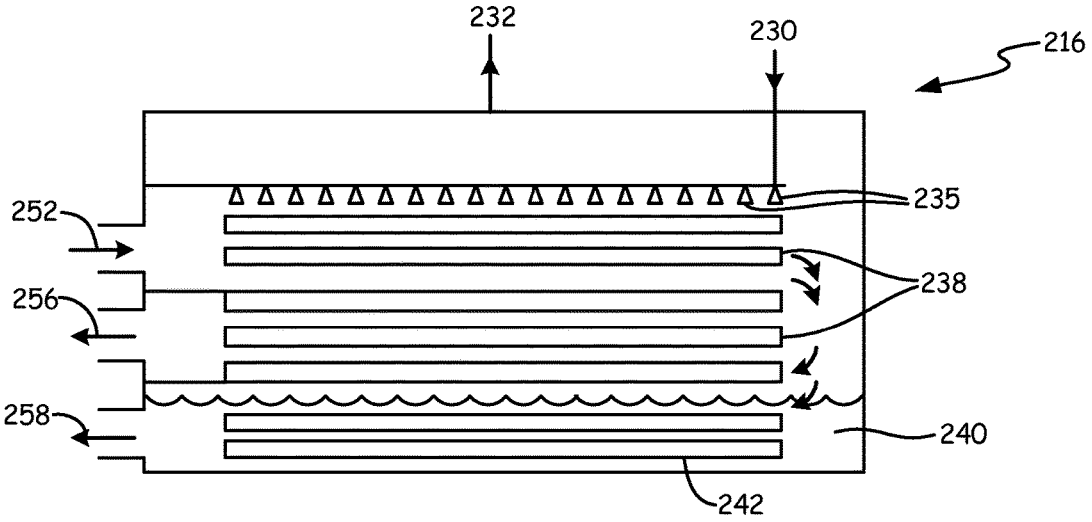
FIG. 4 is a cross section along line 3-3 in FIG. 2 of another alternate embodiment evaporator of the present invention without superheating tubes.

FIG. 4 is a cross section of an alternative embodiment evaporator, evaporator 216, of system 100 along line 3-3 in FIG. 2. Evaporator 216 consists of a shell through which evaporating tubes 238 and pool boiling tubes 242 pass in tube bundles. Evaporator 116 also includes inlet 230, outlet 232, distribution system 233 with spray manifold 234 and spray nozzles 235, pool 240, resource inlet 252, resource inlet 254, resource outlet 256, and resource outlet 258. The fluid processed with evaporator 216 may be a dry working fluid, which does not require superheat. Therefore, evaporator 216 does not include superheating tubes.

During operation of evaporator 216, a resource, such as hot water, flows into evaporating tubes 238 through resource inlet 252. The resource continues to flow through additional evaporating tubes 238 (as shown by the flow direction arrows) and also flows into pool boiling tubes 242. The resource exits evaporating tubes 238 through resource outlet 256 and pool boiling tubes 242 through resource outlet 258.

Subcooled liquid enters evaporator 216 through inlet 230. Distribution system 233 uses spray nozzles 235 attached to spray manifold 234 to spray subcooled fluid at high pressure over evaporating tubes 238. The heat from the resource flowing through evaporating tubes 238 allows the fluid to begin evaporating. The fluid falls down subsequent rows of evaporating tubes 238. The fluid falling off the last row of evaporating tubes 238 collects and forms pool 240 at the bottom of evaporator 216. The heat from the resource flowing through pool boiling tubes 242 causes the fluid in pool 240 to evaporate.

Therefore, the saturated vapor in evaporator 216 consists of fluid evaporated by evaporating tubes 238 and pool boiling tubes 242. The saturated vapor travels up through evaporator 216 and exits evaporator 216 through outlet 232.

DISCUSSION OF POSSIBLE EMBODIMENTS

A system according to an exemplary embodiment of this disclosure, among other possible things includes: a fluid with components that evaporate at different temperatures, a condenser with an inlet and an outlet, a pump with an outlet and with an inlet connected to the outlet of the condenser, and an evaporator. The evaporator includes an inlet connected to the outlet of the pump, an outlet, evaporating tubes, pool boiling tubes, and a fluid distribution system for spraying the fluid over the evaporating tubes. The system further includes a turbine with an inlet connected to the outlet of the evaporator, an outlet connected to the inlet of the condenser, and a drive shaft. A generator is connected to the drive shaft of the turbine.

A further embodiment of the foregoing system, wherein the system is a power generation system.

A further embodiment of any of the foregoing systems, wherein the system is a refrigeration system.

A further embodiment of any of the foregoing systems, wherein the fluid is a mixed refrigerant.

A further embodiment of any of the foregoing systems, wherein the mixed refrigerant has a temperature glide of between 5 and 30 degrees Celsius.

A further embodiment of any of the foregoing systems, wherein the mixed refrigerant comprises a most volatile component and a least volatile component.

A further embodiment of any of the foregoing systems, and further including a controller for controlling the flow of a hot resource through the evaporating tubes and the pool boiling tubes such that the rate of evaporation of the most volatile component and the least volatile component is equal.

A further embodiment of any of the foregoing systems, wherein the fluid has a global warming potential of less than 675.

A further embodiment of any of the foregoing systems, wherein the fluid is non-flammable.

A further embodiment of any of the foregoing systems, wherein the evaporator further includes superheating tubes near the outlet of the evaporator for heating the fluid evaporated by the evaporating tubes and the pool boiling tubes.

A further embodiment of any of the foregoing systems, wherein the superheating tubes are next to the evaporating tubes below the fluid distribution system.

A further embodiment of any of the foregoing systems, wherein the superheating tubes are above the fluid distribution system.

A method of processing a fluid according to an exemplary embodiment of this disclosure; the method, among other possible things includes: condensing the fluid in a condenser, the fluid including components that evaporate at different temperatures, pumping the fluid from the condenser into an evaporator, and spraying the fluid from a fluid distribution system in the evaporator to cover evaporating tubes in the evaporator. The method further includes dripping an excess of the fluid off of the evaporating tubes to form a pool in the evaporator, evaporating the fluid from the evaporating tubes, evaporating the fluid from the pool with pool boiling tubes, expanding the evaporated fluid in a turbine, and producing power in a generator using the fluid expanded in the turbine.

A further embodiment of the foregoing method, wherein the fluid is a mixed refrigerant.

A further embodiment of any of the foregoing methods, wherein the mixed refrigerant has a temperature glide of between 5 and 30 degrees Celsius.

A further embodiment of any of the foregoing methods, wherein the mixed refrigerant includes a most volatile component and a least volatile component.

A further embodiment of any of the foregoing methods, wherein the method further includes controlling the flow of a hot resource through the evaporating tubes and the pool boiling tubes such that the rate of evaporation of the most volatile component and the least volatile component is equal.

A further embodiment of any of the foregoing methods, wherein the fluid has a global warming potential of less than 675.

A further embodiment of any of the foregoing methods, wherein the fluid is non-flammable.

A further embodiment of any of the foregoing methods, the method further including heating the evaporated fluid with superheating tubes prior to expanding the evaporated fluid in the turbine.

A further embodiment of any of the foregoing methods, wherein the excess of fluid dripping off of the plurality of evaporating tubes comprises between 15 and 25 percent of the fluid sprayed from the fluid distribution system.

Although the present invention has been described with reference to preferred embodiments, workers skilled in the art will recognize that changes may be made in form and detail without departing from the spirit and scope of the invention.

The invention claimed is:

1. A system comprising:

a fluid comprising a plurality of components that evaporate at different temperatures;

a condenser with an inlet and an outlet;

a pump with an outlet and with an inlet connected to the outlet of the condenser;

an evaporator comprising:

an inlet connected to the outlet of the pump;

an outlet;

a plurality of evaporating tubes;

a plurality of pool boiling tubes; and a fluid distribution system for spraying the fluid over the plurality of evaporating tubes;

a turbine with an inlet connected to the outlet of the evaporator, an outlet connected to the inlet of the condenser, and a drive shaft; and a generator connected to the drive shaft of the turbine.

2. The system of claim 1, wherein the system is a power generation system.

3. The system of claim 1, wherein the system is a refrigeration system.

4. The system of claim 1, wherein the fluid is a mixed refrigerant.

5. The system of claim 4, wherein the mixed refrigerant has a temperature glide of between 5 and 30 degrees Celsius.

6. The system of claim 4, wherein the mixed refrigerant comprises a most volatile component and a least volatile component.

7. The system of claim 6, and further comprising a controller for controlling the flow of a hot resource through the plurality of evaporating tubes and the plurality of pool boiling tubes such that the rate of evaporation of the most volatile component and the least volatile component is equal.

8. The system of claim 1, wherein the fluid has a global warming potential of less than 675.

9. The system of claim 1, wherein the fluid is non-flammable.

10. The system of claim 1, wherein the evaporator further comprises a plurality of superheating tubes near the outlet of the evaporator for heating the fluid evaporated by the plurality of evaporating tubes and the plurality of pool boiling tubes.

11. The system of claim 10, wherein the plurality of superheating tubes is next to the plurality of evaporating tubes below the fluid distribution system.

12. The system of claim 11, wherein the plurality of superheating tubes is above the fluid distribution system.

13. A method of processing a fluid in a system, the method comprising:

condensing the fluid in a condenser, the fluid comprising a plurality of components that evaporate at different temperatures;

pumping the fluid from the condenser into an evaporator;

spraying the fluid from a fluid distribution system in the evaporator to cover a plurality of evaporating tubes in the evaporator;

dripping an excess of the fluid off of the plurality of evaporating tubes to form a pool in the evaporator;

evaporating the fluid from the plurality of evaporating tubes;

evaporating the fluid from the pool with a plurality of pool boiling tubes;

expanding the evaporated fluid in a turbine; and producing power in a generator using the fluid expanded in the turbine.

14. The method of claim 13, wherein the fluid is a mixed refrigerant.

15. The method of claim 14, wherein the mixed refrigerant has a temperature glide of between 5 and 30 degrees Celsius.

16. The method of claim 14, wherein the mixed refrigerant comprises a most volatile component and a least volatile component.

17. The method of claim 16, and further comprising controlling the flow of a hot resource through the plurality of evaporating tubes and the plurality of pool boiling tubes such that the rate of evaporation of the most volatile component and the least volatile component is equal.

18. The method of claim 13, wherein the fluid has a global warming potential of less than 675.

19. The method of claim 13, wherein the fluid is non-flammable.

20. The method of claim 13, and further comprising heating the evaporated fluid with a plurality of superheating tubes prior to expanding the evaporated fluid in the turbine.

21. The method of claim 13, wherein the excess of fluid dripping off of the plurality of evaporating tubes comprises between 15 and 25 percent of the fluid sprayed from the fluid distribution system.

* * * * *